US007685867B2

(12) United States Patent
Tsuyuki et al.

(10) Patent No.: US 7,685,867 B2
(45) Date of Patent: Mar. 30, 2010

(54) LEAK DIAGNOSTIC APPARATUS FOR A VAPORIZED FUEL PROCESSING SYSTEM

(75) Inventors: Takeshi Tsuyuki, Kanagawa (JP); Hiroya Ishii, Kanagawa (JP); Kazuhisa Watanabe, Murfreesboro, TN (US)

(73) Assignee: Nissan Motor Co., Ltd., Yokohama (JP)

( * ) Notice: Subject to any disclaimer, the term of this patent is extended or adjusted under 35 U.S.C. 154(b) by 652 days.

(21) Appl. No.: 11/528,208

(22) Filed: Sep. 27, 2006

(65) Prior Publication Data

US 2007/0068227 A1 Mar. 29, 2007

(30) Foreign Application Priority Data

Sep. 28, 2005 (JP) ..... 2005-281577

(51) Int. Cl.
*G01M 3/04* (2006.01)

(52) U.S. Cl. ..... 73/49.7; 73/49.2

(58) Field of Classification Search ..... 73/49.7
See application file for complete search history.

(56) References Cited

U.S. PATENT DOCUMENTS 5,679,890 A * 10/1997 Shinohara et al. ..... 73/114.39
6,321,727 B1 * 11/2001 Reddy et al. ..... 123/520

* cited by examiner

*Primary Examiner*—Hezron Williams
*Assistant Examiner*—Mark Shabman
(74) *Attorney, Agent, or Firm*—Global IP Counselors, LLP

(57) ABSTRACT

A leak diagnostic apparatus for a vaporized fuel processing system that purges vaporized fuel in a fuel tank of a vehicle is disclosed. The leak diagnostic apparatus comprises a leak diagnostic device, a fuel tank condition detection device and a determining device. The leak diagnostic device carries out a leak diagnosis of the vaporized fuel processing system while the engine is operating. The fuel tank condition detection device detects the conditions in the fuel tank. The determining device determines whether the leak diagnosis should be carried out based on predetermined conditions in the fuel tank.

11 Claims, 6 Drawing Sheets

LEAK DIAGNOSTIC APPARATUS FOR A VAPORIZED FUEL PROCESSING SYSTEM

CROSS-REFERENCES TO RELATED APPLICATION

This application claims priority from Japanese Patent Application Serial No. 2005-281577 filed Sep. 28, 2005, the content of which is incorporated herein by reference in its entirety.

TECHNICAL FIELD

The present disclosure relates to a leak diagnostic apparatus for a vaporized fuel processing system.

BACKGROUND

Automobile engines are comprised of a vaporized fuel processing system in which the vaporized fuel gas (hereinafter referred to as vapor) that is generated in the fuel tank is adsorbed by active carbon in a canister, and under designated operational conditions, by using the negative-pressure of the inlet passage, the fuel particles adsorbed in the canister are desorbed from the active carbon and led to an inlet pipe, which is downstream of a throttle valve, and combusted.

In this case, if a leak hole exists in the middle of a flow path from the fuel tank to the inlet pipe, or if sealing at the joint of the inlet pipe becomes poor, the vapor is discharged to the atmosphere and therefore, leak diagnostic methods have been proposed. U.S. Pat. No. 6,321,727 discloses a leak diagnostic apparatus for a vaporized fuel processing system. However, the leak diagnostic process is not started until the engine is stopped and the leak diagnostic apparatus confirms that the temperature inside the fuel tank is the same or greater than a designated value, relative to the atmosphere temperature.

SUMMARY

A high precision leak diagnostic apparatus for a vaporized fuel processing system is disclosed. In one embodiment of a leak diagnostic apparatus for a vaporized fuel processing system that purges vaporized fuel in a fuel tank of a vehicle, the leak diagnostic apparatus comprises a leak diagnostic device, a fuel tank condition detection device and a determining device. The leak diagnostic device carries out a leak diagnosis of the vaporized fuel processing system while the engine is operating. The fuel tank condition detection device detects the conditions in the fuel tank. The determining device determines whether the leak diagnosis should be carried out based on predetermined conditions in the fuel tank.

Based on the present disclosure, a leak diagnose is carried out depending on the conditions in the fuel tank, such that a high precision leak diagnostic device for a vaporized fuel processing system is provided.

BRIEF DESCRIPTION OF DRAWINGS

Other features and advantages of the present system will be apparent from the ensuing description, taken in conjunction with the accompanying drawings, in which.

DETAILED DESCRIPTION

Figure 1:
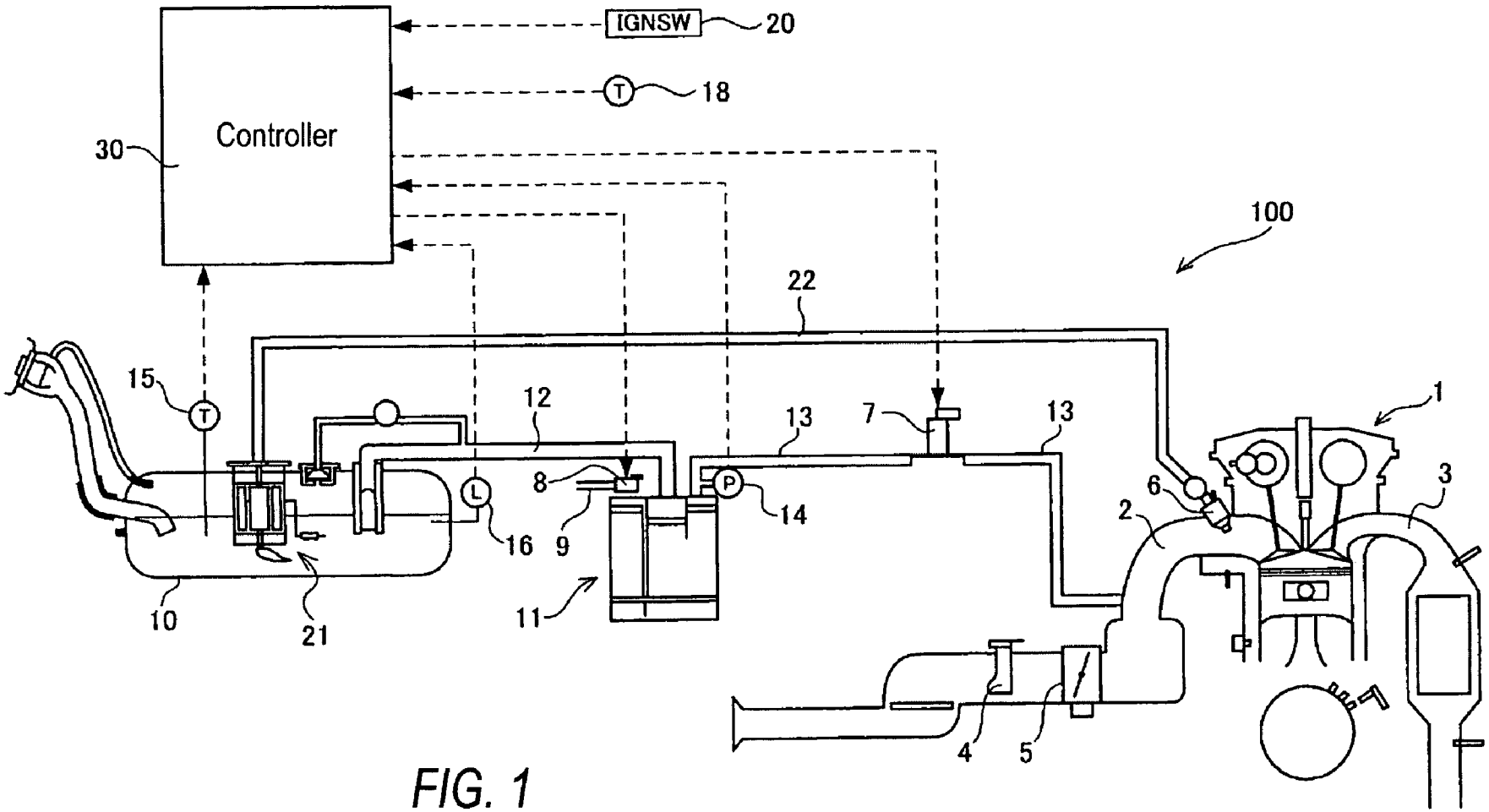
FIG. 1 is a schematic drawing illustrating the structure of a leak diagnostic device for a vaporized fuel processing system.

While the claims are not limited to the illustrated embodiments, an appreciation of various aspects of the system is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows:

Embodiment 1

FIG. 1 is a schematic drawing that illustrates the structure of a leak diagnostic device for a vaporized fuel processing system based on the present invention.

FIG. 1 includes an engine 1, an inlet passage 2 for the engine 1, and an exhaust passage 3 for the same. An intake air flow sensor 4 that detects the amount of intake air and a throttle valve 5, which is positioned downstream and controls the intake air amount, are provided in the inlet passage 2. Additionally, a fuel injection valve 6 that is positioned downstream of the throttle valve 5 and that injects fuel is provided in the inlet passage 2. From the fuel injection valve 6, the appropriate amount of fuel for the intake air amount is injected, and the mixture of this fuel and air is combusted in the engine 1, and therefore the engine 1 generates power.

A fuel tank 10 is also provided, wherein the fuel tank 10 stores the fuel to be supplied to the engine 1. A fuel pump 21 that pressure feeds the fuel is provided in the fuel tank 10 and the fuel is supplied to the fuel injection valve 6 via a fuel passage 22. In addition, a vaporized fuel processing system 100 is provided to temporarily adsorb and retain the vapor generated in the fuel tank 10, and also so that the vapor that is adsorbed and retained can be taken in by the engine 1 and combusted under the appropriate operating conditions.

The vaporized fuel processing system 100 is comprised of a canister 11 filled with active carbon that adsorbs and retains the vapor. The canister 11 is connected to the fuel tank 10 via a vapor passage 12, and is also connected to the inlet passage 2 via a purge passage 13 on the downstream side of the throttle valve 5.

A purge control valve 7 that adjusts the amount of vapor to be purged into the inlet passage 2 (hereinafter referred to as the "purge amount") is provided in the purge passage 13. In principle, the purge control valve 7 is usually closed. However, during purging that is carried out under designated operating conditions, purge control valve 7 is controlled to be opened and closed by a controller 30, which is described below.

The canister 11 is also connected to the atmosphere via an atmosphere opening 9. A drain cut valve 8 is provided at the atmosphere opening 9, and its operation is controlled by the controller 30. In principle, the drain cut valve 8 is always open regardless of whether the engine 1 is in operation or not. However, the drain cut valve 8 is closed during the leak diagnosis that is described below, and it creates a closed space in the system (hereinafter referred to as "in the system"), which is comprised of the fuel tank 10, the vapor passage 12, the canister 11 and the purge passage 13 from the canister 11 to the purge control valve 7.

A pressure sensor 14 that detects the pressure in the purge passage 13 is provided in the purge passage 13 between the canister 11 and the purge control valve 7. This pressure sensor 14 outputs a signal, which corresponds to the pressure in the system, to the controller 30.

Additionally, a variety of detection signals, coming from a fuel temperature sensor 15 that detects the fuel temperature in the fuel tank 10, a fuel level sensor 16 that detects the fuel level, an ambient temperature sensor 18 that detects the ambient temperature, and a switching signal from an ignition switch 20, are inputted to the controller 30.

The controller 30 is comprised of a CPU, ROM, and RAM (not shown in the drawing), etc., and opens the purge control valve 7 under a designated operation condition, and carries out purging of the vapor by letting the fuel adsorbed in the canister 11 to be taken into the engine 1 from the inlet passage 2 to combust.

At the same time, when carrying out a moving vehicle leak diagnosis, controller 30 reduces the pressure inside the system, by using a negative pressure that is generated downstream of the throttle valve 5 of the engine 1 by opening the purge control valve 7 and closing the drain cut valve 8. Then, after the pressure is reduced, it closes the purge control valve 7, to make a closed space in the system, and leak diagnosis is carried out through the measurement of the pressure change in the system.

In addition, when a stationary vehicle leak diagnosis is carried out, controller 30 closes the purge control valve 7 and the drain cut valve 8 after the engine has stopped to create a closed space in the system and the controller 30 carries out leak diagnosis based on the changes in pressure due to the negative pressure that is normally generated due to the decrease in the fuel temperature in the fuel tank 10.

Figure 2:
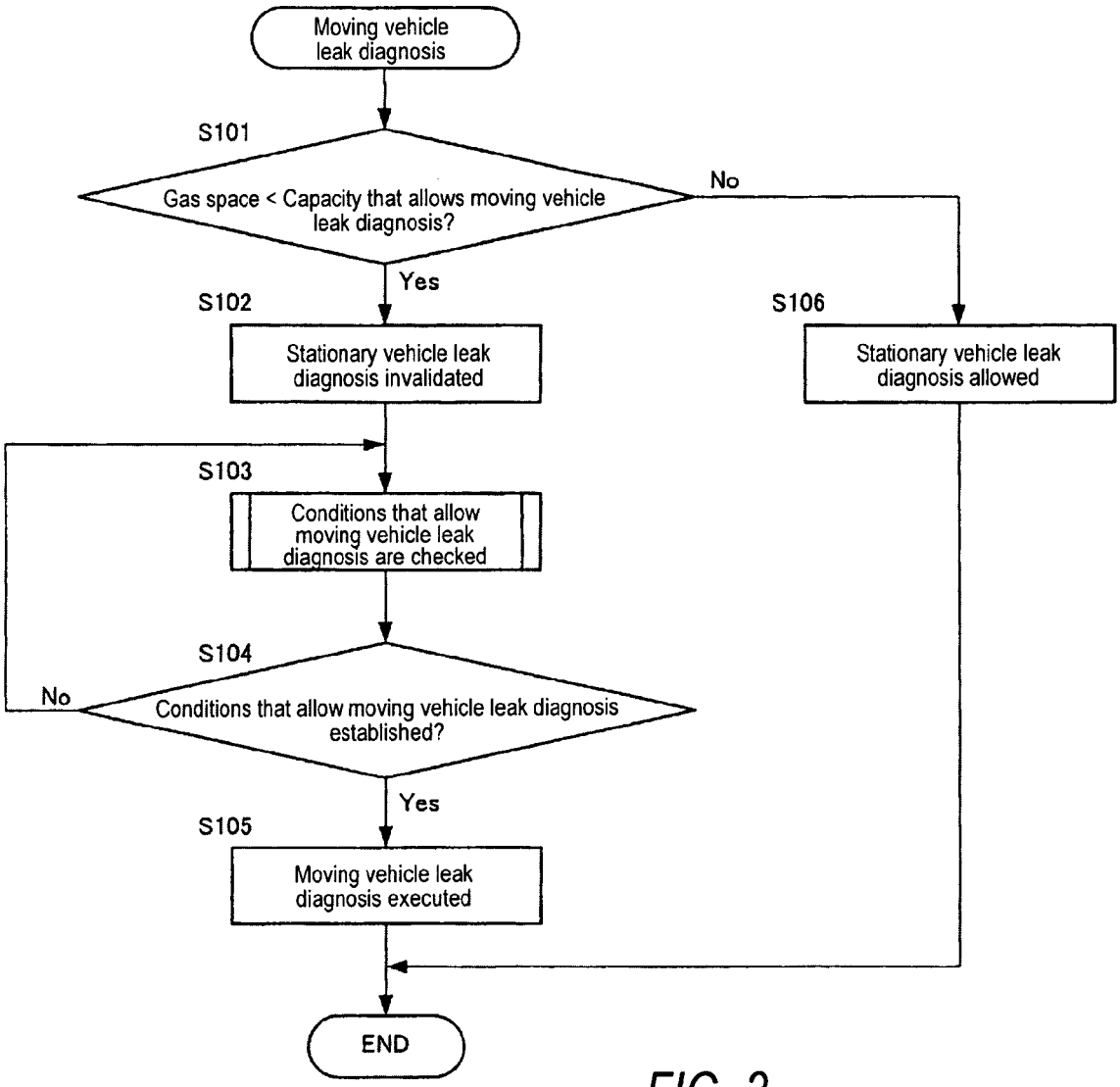
FIG. 2 is a flowchart illustrating the operation of the leak diagnostic device for a vaporized fuel processing system in a moving vehicle.
Figure 3:
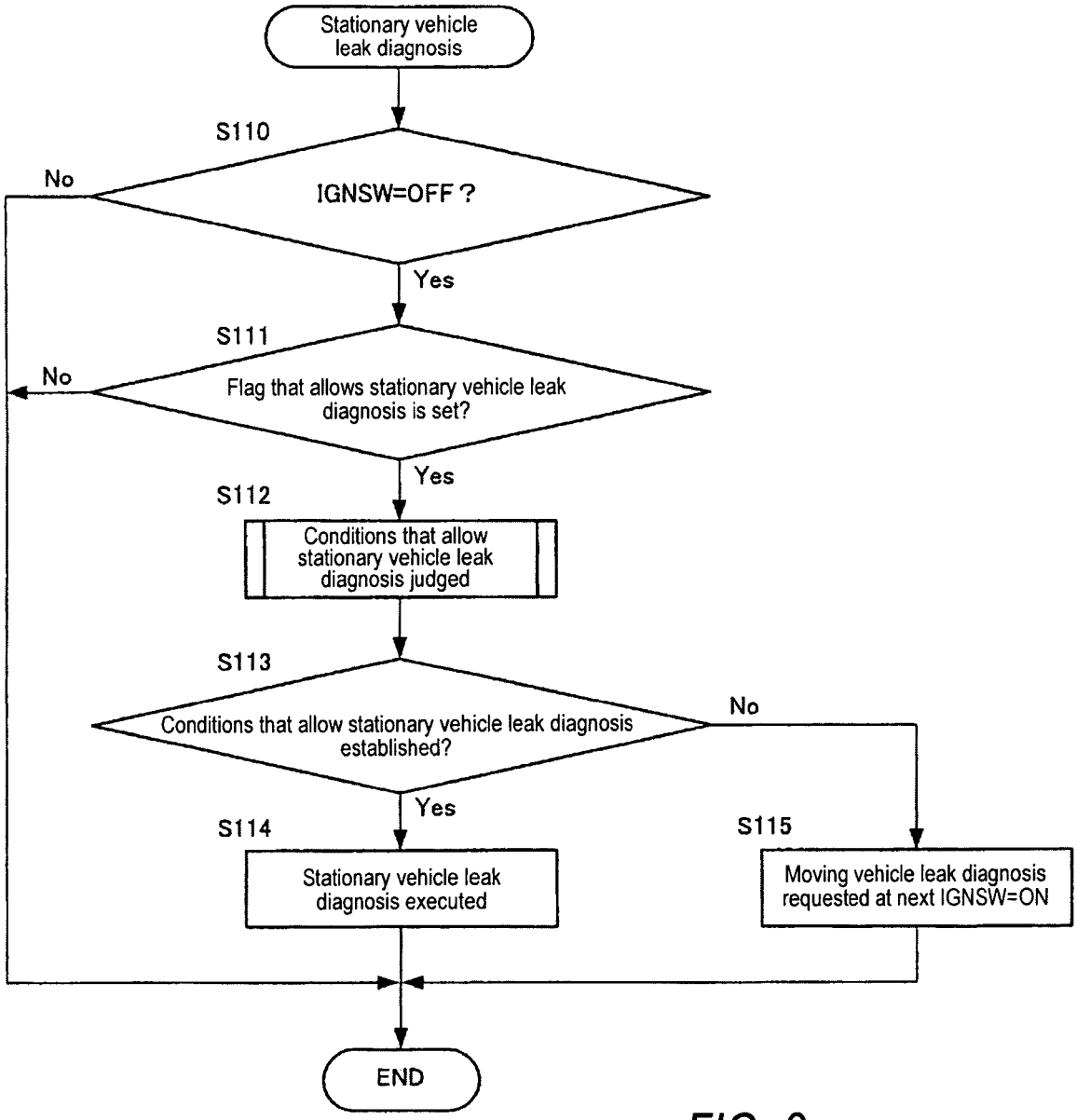
FIG. 3 is a flowchart illustrating the operation of the leak diagnostic device for a vaporized fuel processing system in a stationary vehicle.

The moving vehicle leak diagnosis and the stationary vehicle leak diagnosis, which are executed by the controller 30, are described in detail by referring to the flowcharts in FIGS. 2 and 3. The processes that are described in the flowcharts of FIGS. 2 and 3 are repeatedly executed after each designated unit of time.

First, the "moving vehicle leak diagnosis routine", as shown in FIG. 2, determines whether or not a stationary vehicle leak diagnosis should be invalidated based on the gas space in the fuel tank 10. When it is invalidated, a moving vehicle leak diagnosis is carried out, if the conditions that allow a moving vehicle leak diagnosis are established. Each process in the "moving vehicle leak diagnosis routine" is described as follows.

First, at Step S101, whether the gas space in the fuel tank 10 is less than a designated volume or not is determined. If the gas space in the fuel tank 10 is less than the designated volume, namely if the fuel level in the fuel tank is at a certain value or greater, it proceeds to Step S102 and a flag, which invalidates the stationary vehicle leak diagnosis, is set. On the other hand, if the gas space in the fuel tank 10 is at the designated volume or greater, namely if the fuel level in the fuel tank 10 is less than a certain value, it proceeds to Step S106, and a flag to allow the stationary vehicle leak diagnosis is set and the processing of the routine is completed.

As described above, during the moving vehicle leak diagnosis, the pressure inside the system is reduced using the negative pressure generated downstream of the throttle valve 5 of the engine 1. After the pressure is reduced, a closed space is created in the system and the changes in pressure are monitored. Additionally, the leak diagnosis is determined from the pressure change speed at that time.

If there is no leak, the change in pressure is obviously small, and the gradient of the pressure change speed becomes small. In contrast, if there is a leak, fresh air is introduced there and a pressure change from a negative pressure to the atmospheric pressure is generated. At that time, if the gas space in the fuel tank 10 is small, the time it takes to reach the atmospheric pressure from a negative pressure is short and the gradient of the pressure change speed becomes large. On the other hand, if the gas space is large, the gradient of the pressure change speed becomes small.

Therefore, if the gas space is large, even though there is a leak, a determination may be made based on a small detected pressure change that there is no leak, such that a misdiagnosis may occur.

Using the negative pressure that is normally generated due to a decrease in the fuel temperature in the fuel tank 10 after the engine is stopped, the transition of the differential pressure between the pressure inside the system, which is a closed space, and the atmospheric pressure is monitored, and thus the stationary vehicle leak diagnosis is carried out based on the amount of fluctuation of the differential pressure. Therefore, if there is no leak, then along with the temperature change, a large pressure change in the system is observed. If there is a leak, fresh air is introduced and the pressure change is small.

In general, the temperature of the fuel in the fuel tank 10 increases by receiving heat from outside due to the heat released from the exhaust system, etc., while the vehicle is moving. If the increase of the fuel temperature is insufficient, the temperature change after the engine is stopped will be small, and therefore, the pressure change is small, so that determining whether there is a leak or not is difficult, and a misdiagnosis may occur.

Thus, if the fuel in the fuel tank 10 receives the same amount of heat, then, as the remaining amount of fuel becomes greater, the increase in the fuel temperature becomes smaller. Further, there is a smaller decrease in temperature change after the engine is stopped, and therefore it is difficult to detect a pressure change and the possibility of a misdiagnosis increases.

As described above, during a moving vehicle leak diagnosis, the pressure change in the system, which is a diagnostic parameter, is more easily detected when the gas space in the system is small (a large amount of remaining fuel), and furthermore, the difference due to the change in pressure because of the existence of a leak is difficult to detect when the gas space in the system is large. In contrast, during a stationary vehicle leak diagnosis, the pressure difference in the fuel tank 10 generated by the change in the fuel temperature inside is used so that a diagnosis with a higher precision can be expected when there is a large gas space (a small amount of remaining fuel) because it has a small heat capacity.

Therefore, when the gas space in the fuel tank 10 is small, in other words, when the fuel level is high and the amount of remaining fuel is large, a moving vehicle leak diagnosis is carried out and a stationary vehicle leak diagnosis is not allowed in order to prevent a misdiagnosis and therefore the diagnostic precision is improved. In addition, when the gas space in the fuel tank 10 is large, in other words, when the fuel level is low and the amount of remaining fuel is small, a stationary vehicle leak diagnosis is carried out and a moving vehicle leak diagnosis is not allowed in order to prevent a misdiagnosis and therefore the diagnostic precision is improved.

The process flow is described again as follows. When the process proceeds to Step S102 and a flag that invalidates a stationary vehicle leak diagnosis is set, it proceeds to Step S103.

At Step S103, the processing of the "subroutine to check the conditions that allow a moving vehicle leak diagnosis" is carried out in order to determine whether or not the conditions that allow a moving vehicle leak diagnosis are fulfilled. The processing of the "subroutine to check the conditions that allow a moving vehicle leak diagnosis" is described by referring to FIG. 5.

First, at Step S301, a determination is made as to whether or not a flag to request a moving vehicle leak diagnosis was set during a stationary vehicle leak diagnosis, which is described below. If a flag was set, it proceeds to Step S302. If the flag was not set, it proceeds to Step S307, and the processing of the subroutine is completed with a failure to meet the conditions that allow for the moving vehicle leak diagnosis.

From Steps S302 to S305, whether or not the starting water temperature is at a certain value or greater, whether or not the fuel temperature is within a certain range, whether or not the atmospheric pressure is at a certain value or greater, and whether or not the fuel level is within a certain range are determined. When these conditions that allow a moving vehicle leak diagnosis are all fulfilled, it proceeds to Step S306, and the processing of the subroutine is completed with the establishment of the conditions that allow for a moving vehicle leak diagnosis. When any one of the above-mentioned conditions is not fulfilled, it proceeds to Step S307, and the processing of the subroutine is completed with a failure to meet the conditions that allow for a moving vehicle leak diagnosis.

Referring back to FIG. 2, once the subroutine process is completed, it proceeds to Step S104. At that time, during the subroutine, if the conditions that allow for a moving vehicle leak diagnosis are established, it proceeds to Step S105, and a moving vehicle leak diagnosis is carried out. If the conditions that allow for a moving vehicle leak diagnosis are not established, it goes back to Step S103 in order to execute again the judgment as to whether the conditions that allow the diagnosis are fulfilled.

When the subroutine proceeds to Step S105, a moving vehicle leak diagnosis is carried out, and a closed space is created in the system that has its pressure decreased using the negative pressure of the engine, and whether or not a leak exists is determined by measuring the pressure change in the system.

Next, during the "routine for a stationary vehicle leak diagnosis" shown in FIG. 3, if no flag to invalidate a stationary vehicle leak diagnosis was set during the "routine for a moving vehicle leak diagnosis" in FIG. 2, then, a stationary vehicle leak diagnosis is carried out with the presumption of the establishment of the conditions allowing a stationary vehicle leak diagnosis. Each process in the "routine for a stationary vehicle leak diagnosis" is described as follows.

First, at Step S110, in order to determine whether or not the engine is turned off, a check is made as to whether the ignition switch (IGNSW) 20 is off or not. When the ignition switch 20 is off, in other words, when the engine is in an off state, the routine proceeds to Step S111. If the ignition switch 20 is not off, in other words, if the engine is on, the routine processing is terminated.

After proceeding to Step S111, if a flag that invalidates the stationary vehicle leak diagnosis was not set during the "moving vehicle leak diagnosis routine" in FIG. 2, then it proceeds to Step S112. If the flag was set, the processing of the routine is terminated.

Figure 6:
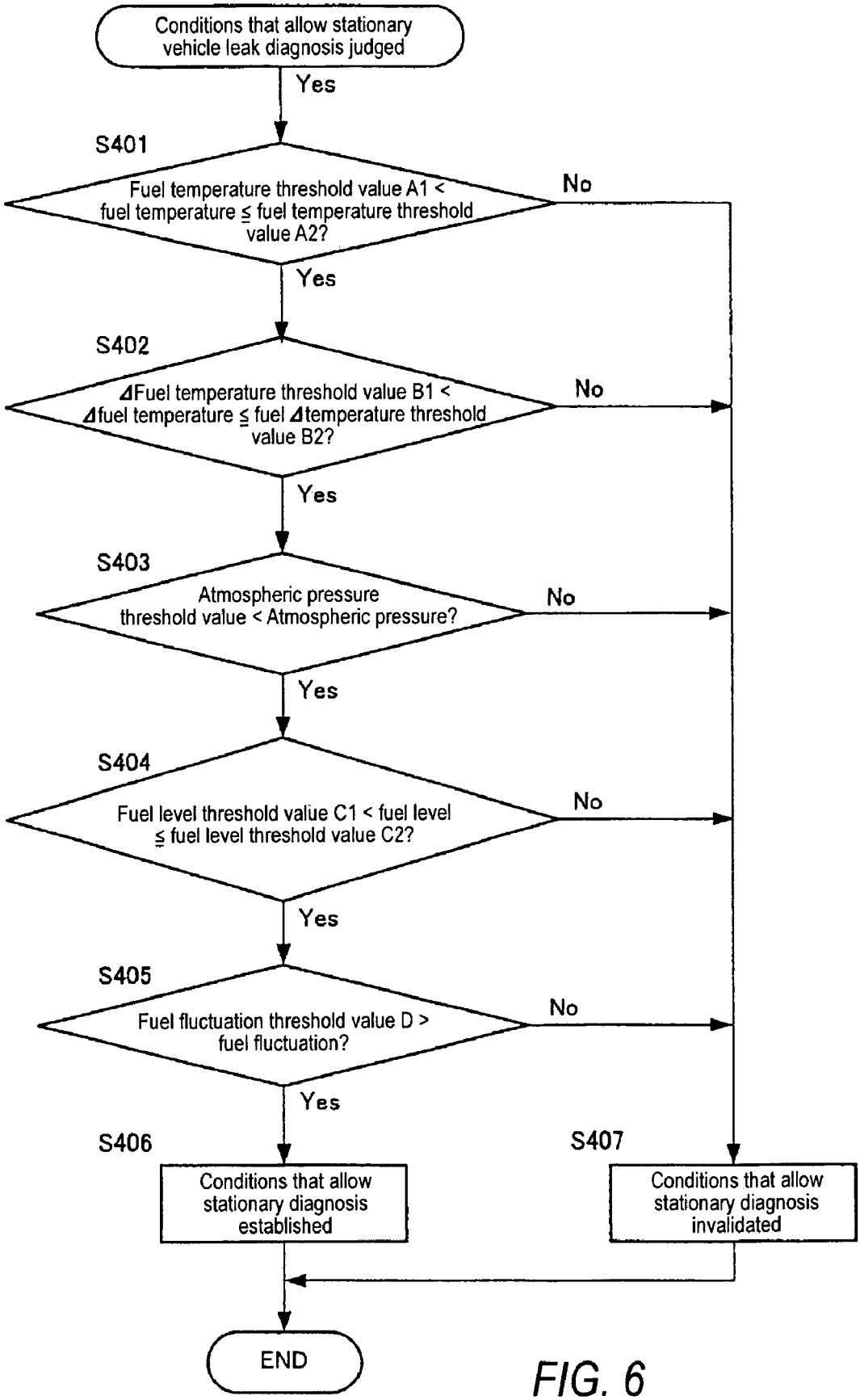
FIG. 6 is a flowchart illustrating a verification process of the leak diagnostic device for a vaporized fuel processing system in a stationary vehicle.

At Step S112, the process of a "subroutine that checks for the conditions that allow a stationary vehicle leak diagnosis" is executed to determine whether or not the conditions are fulfilled that allow a stationary vehicle leak diagnosis. The process of the "subroutine that checks for the conditions that allow a stationary vehicle leak diagnosis" is described by referring to FIG. 6.

From Steps S401 to 405, a determination is made as to whether or not the fuel temperature is within a certain range, the amount of change in the fuel temperature is within a certain range, the atmospheric pressure is at a certain value or greater, the fuel level is within a certain range, and the fuel fluctuation is at a certain value or less. If all of these conditions, which allow a stationary vehicle leak diagnosis, are fulfilled, it proceeds to Step S406 and the subroutine processing is terminated because the conditions that allow a stationary vehicle leak diagnosis are established. In contrast, if any one of these conditions is not fulfilled, it proceeds to Step S407, and the subroutine processing is terminated because the conditions that allow a stationary vehicle leak diagnosis are not established.

Referring back to FIG. 3, when the processing of the subroutine is terminated, it proceeds to Step S113. At this time, if the conditions to allow a stationary vehicle leak diagnosis are established during the subroutine, it proceeds to Step S114 and the stationary vehicle leak diagnosis is carried out. If the conditions to allow a stationary vehicle leak diagnosis are not established, then it proceeds to Step S115, and when the ignition switch 20 is turned on the next time, a flag that requests the execution of the above-mentioned moving vehicle leak diagnosis is set, and the processing of the routine is terminated.

When the process proceeds to Step S114, the stationary vehicle leak diagnosis is carried out, and by using the negative pressure, which is naturally generated in the system due to the temperature change because of the natural heat released by the fuel after the engine is turned off, whether or not there is a leak is determined based on the amount of change in the differential pressure between the pressure in the system and the atmospheric pressure.

According to the leak diagnostics apparatus for a vaporized fuel processing system of the first embodiment as described above, whether to execute a moving vehicle leak diagnosis or a stationary vehicle leak diagnosis is decided based on the size of the gas space in the fuel tank 10. The moving vehicle leak diagnosis easily detects the pressure change in the system when the gas space in the fuel tank 10 is small (the amount of remaining fuel is large), thereby allowing a high precision diagnosis. In contrast, the stationary vehicle leak diagnosis uses the pressure change generated by the change in the fuel temperature in the fuel tank 10, and therefore a high precision diagnosis can be expected when the gas space is large (the amount of remaining fuel is small) and the heat capacity is small.

Therefore, as described above, a high precision leak diagnosis can be carried out by executing a different leak diagnosis by determining whether to execute a moving vehicle leak diagnosis or a stationary vehicle leak diagnosis based on the conditions inside the fuel tank, in other words, depending on the size of the gas space. In addition, the existence of a leak may be checked by a moving vehicle leak diagnosis or a stationary vehicle diagnosis with regard to an area for which conventionally, a leak diagnosis could not be carried out, such as, when the gas space is large in the case of a moving vehicle leak diagnosis. Consequently, the number of executions for leak diagnosis may be increased.

When the moving vehicle leak diagnosis is executed, the stationary vehicle leak diagnosis is invalidated, and therefore the number of executions of the stationary vehicle leak diagnosis can be limited, reducing the battery load. The stationary leak diagnosis puts a load on the battery after the engine is stopped because it requires electric conduction in order to close the drain cut valve 8 after the engine is stopped.

Embodiment 2

The structure of the leak diagnosis apparatus for a vaporized fuel processing system according to Embodiment 2 is the same as that of Embodiment 1. However, the leak diagnosis process executed by the controller 30 according to Embodiment 2 is different from the leak diagnosis process according to Embodiment 1, in which different leak diagnoses are executed by determining which diagnosis to carry out based on the fuel temperature.

Figure 4:
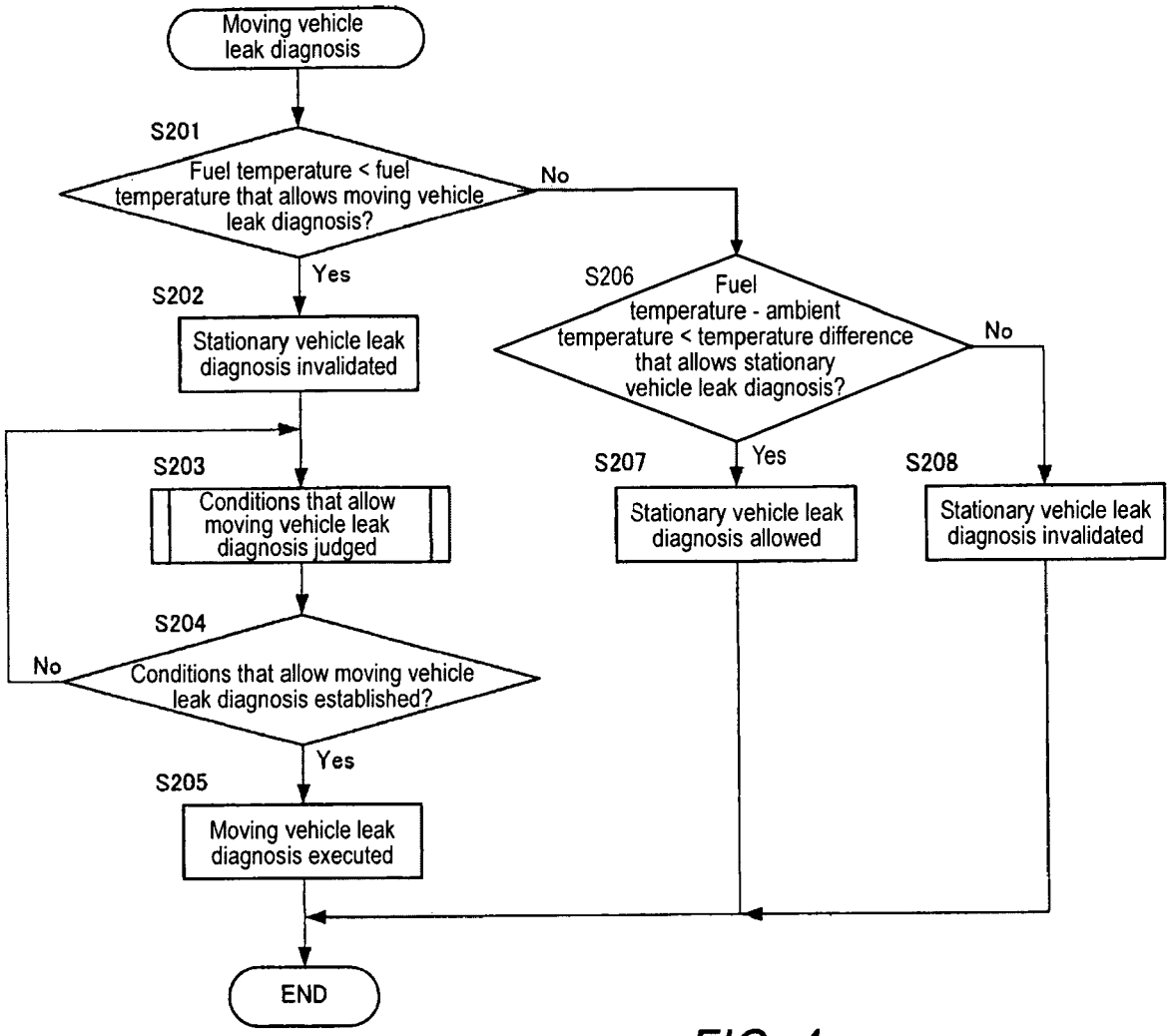
FIG. 4 is a flowchart illustrating the operation of another embodiment of the leak diagnostic device for a vaporized fuel processing system.

The leak diagnosis process of Embodiment 2 that is executed by the controller 30 is described in detail by referring to the flowchart in FIG. 4. The process of the flowchart in FIG. 4 is repeatedly executed after each designated unit of time.

In the "routine for a moving vehicle leak diagnosis" shown in FIG. 4, first, whether or not the stationary vehicle leak diagnosis is invalidated is determined based on the fuel temperature in the fuel tank 10. When the stationary vehicle leak diagnosis is invalidated, if the conditions that allow a moving vehicle leak diagnosis are established, the moving vehicle leak diagnosis is carried out. In contrast, when the stationary vehicle leak diagnosis is not invalidated, whether or not a stationary vehicle leak diagnosis is invalidated is then determined based on the temperature difference between the fuel temperature and ambient temperature. Each process in the "routine for a moving vehicle leak diagnosis" based on Embodiment 2 is described as follows.

At Step S201, whether or not the fuel temperature in the fuel tank 10 is less than the designated fuel temperature is determined. If the fuel temperature in the fuel tank 10 is less than the designated fuel temperature, it proceeds to Step S202, and a flag that invalidates a stationary vehicle leak diagnosis is set. In contrast, if the fuel temperature in the fuel tank 10 is at the designated fuel temperature or greater, it proceeds to Step S206 and whether or not the temperature difference between the fuel temperature and the ambient temperature is at the designated value or greater is further determined.

As described above, the moving vehicle leak diagnosis reduces the pressure inside the system down to the target pressure using negative pressure that is generated downstream of the throttle valve 5 of the engine 1. After the pressure is reduced, a closed space is created in the system and the pressure change is monitored. If there is a leak, then fresh air is introduced from the leak and a pressure change is generated from the negative pressure level to the atmospheric pressure level. If there is no leak, the pressure change is obviously small.

While the vehicle is moving, vapor is generated in the fuel tank 10 when the fuel temperature increases, by receiving external heat due to the heat released from the exhaust system, etc. If the moving vehicle leak diagnosis is carried out when the vapor is being generated, the pressure change generated by the vapor generation may be misdiagnosed as a pressure change due to the fresh air introduced by the leak.

As the fuel temperature becomes higher, a greater amount of vapor generation is promoted. Therefore, in order to prevent a misdiagnosis due to the vapor during the moving vehicle leak diagnosis, it is desirable to carry out the execution under conditions in which the fuel temperature is lower relative to the ambient temperature.

Therefore at Step S201, whether or not the fuel temperature in the fuel tank 10 is lower than the designated fuel temperature is first determined, and whether or not a moving vehicle leak diagnosis should be carried out is determined.

In contrast, the transition of the differential pressure between the pressure inside the system, which is a closed space, and the atmospheric pressure, is monitored by using the negative pressure that is naturally generated due to the decrease in fuel temperature in the fuel tank 10 after the engine is stopped, and based on the amount of change of the differential pressure, the stationary vehicle leak diagnosis is carried out. When there is no leak, a large pressure change is observed in the system along with the temperature change. When there is a leak, the pressure change is small because fresh air is introduced from the leak.

In general, the temperature of the fuel in the fuel tank 10 increases by receiving external heat due to the heat release from the exhaust system, etc., while the vehicle is moving. When the temperature increase of the fuel temperature at that time is insufficient, the temperature change after the engine is stopped is small. Therefore the pressure change becomes small. In other words, even if there is a leak, a misdiagnosis that there is no leak may occur.

Therefore, the higher the fuel temperature becomes after the engine is stopped relative to the ambient temperature, the larger the temperature change is after that and a pressure change is easily obtained. Therefore, it is desirable to carry out the stationary vehicle leak diagnosis in the case that the fuel temperature is higher relative to the ambient temperature. In other words, even if the fuel temperature in the fuel tank 10 is high, if the temperature difference with the ambient temperature is small, the temperature change due to the natural heat release after the engine is stopped becomes small.

Even in the case where the moving vehicle leak diagnosis is invalidated at Step S201 because the fuel temperature is at the designated value or greater, in other words, even if the conditions exist that allow a stationary vehicle leak diagnosis to be carried out with high precision, whether or not the temperature difference between the fuel temperature and the ambient temperature is at the designated value or greater is additionally determined at Step S206, and whether or not the stationary vehicle leak diagnosis should be carried out is determined.

As described above, when the fuel temperature in the fuel tank 10 is low, it is difficult to be affected by the vapor, and the moving vehicle leak diagnosis can be carried out. In addition, a stationary vehicle leak diagnosis, for which the pressure change after the engine is stopped is small, is invalidated, thereby preventing a misdiagnosis, and improving the diagnostic precision. Furthermore, even if the fuel temperature in the fuel tank 10 is high, if the temperature difference with the ambient temperature is low, the temperature change due to the natural heat release after the engine is stopped is small. Therefore, the pressure change becomes small and the risk of a misdiagnosis increases, and thus, even if the fuel temperature is high, a stationary vehicle leak diagnosis is invalidated and therefore, the diagnostic precision is improved.

The process flow is described again. When the process proceeds from Steps S201 to S202, a flag that invalidates the stationary vehicle leak diagnosis is set, and it proceeds to Step S203.

Figure 5:
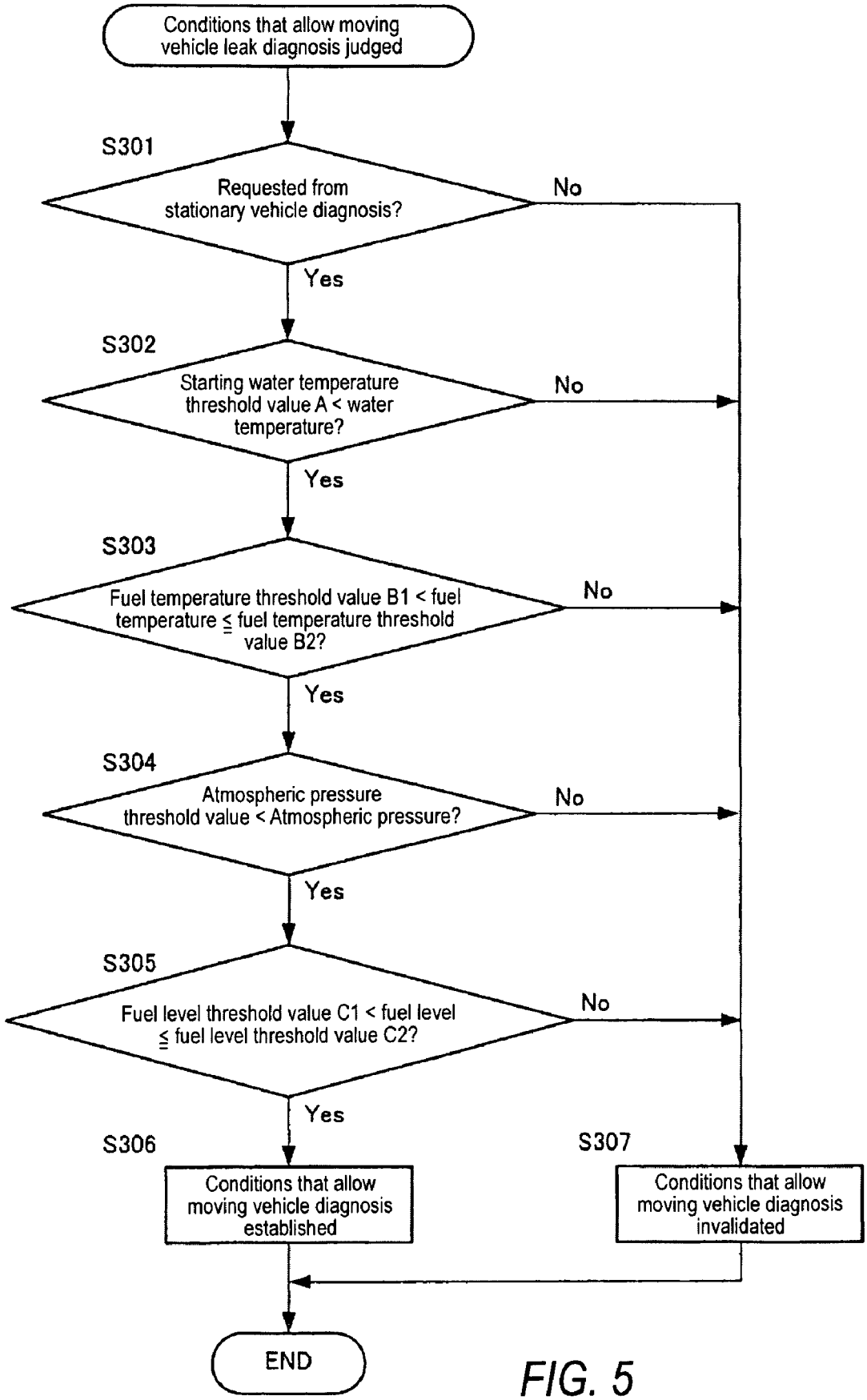
FIG. 5 is a flowchart illustrating a verification process of the leak diagnostic device for a vaporized fuel processing system in a moving vehicle.

At Step S203, the processing of a "subroutine that checks for the conditions that allow a moving vehicle leak diagnosis" in FIG. 5 is executed. The processing of the "subroutine that checks for the conditions that allow a moving vehicle leak diagnosis" according to Embodiment 2 is the same as that of Embodiment 1 and for brevity, the description is hereby omitted. When the processing of the subroutine is completed, it proceeds to Step S204. At that time, if the conditions that allow a moving vehicle leak diagnosis are established during the subroutine, it proceeds to Step S205, and the moving vehicle leak diagnosis is carried out. If the conditions that allow a moving vehicle leak diagnosis are not established it returns to Step S203 in order to execute, again, the checking for the conditions that allow the diagnosis.

When it proceeds to Step S205, the moving vehicle leak diagnosis is carried out, and a closed space is created in the system in which the pressure is reduced by using the negative pressure of the engine, and a judgment as to whether or not the leak exists is carried out by measuring the pressure change in the system afterwards, and the processing of the routine is completed.

As described above, if the fuel temperature in the fuel tank 10 is at the designated fuel temperature or greater at Step S201, it proceeds to Step S206, and whether or not the temperature difference between the fuel temperature and the ambient temperature is at the designated value or greater is further checked. If the temperature difference is at the designated value or greater it proceeds to Step S207, and a flag that allows the stationary vehicle leak diagnosis is set. If the temperature difference is smaller than the designated value, the process proceeds to Step S208, and a flag that invalidates the stationary vehicle leak diagnosis is set.

When a flag that allows a stationary vehicle leak diagnosis or a flag that invalidates the stationary vehicle leak diagnosis is set at Steps S207 or S208, respectively, the processing of the routine is completed.

The processing of the stationary vehicle leak diagnosis according to Embodiment 2 is the same as that of Embodiment 1.

According to the above-mentioned leak diagnosis apparatus for the vaporized fuel processing system of Embodiment 2, whether or not to carry out a moving vehicle leak diagnosis or a stationary vehicle leak diagnosis is determined based on the fuel temperature in the fuel tank 10, and a different leak diagnosis is carried out.

As the fuel temperature becomes higher, a greater amount of vapor generation is promoted, and therefore it is desirable to carry out the moving vehicle leak diagnosis, which is easily affected by the vapor, at a low fuel temperature. On the other hand, the stationary vehicle leak diagnosis is carried out based on the pressure difference generated by the fuel temperature change in the fuel tank 10. Therefore, it is desirable to carry out the leak diagnosis when the fuel temperature is higher relative to the ambient temperature because the temperature change after the engine is stopped becomes larger and the pressure change becomes larger and therefore a high precision diagnosis can be expected.

Therefore, whether or not to carry out a moving vehicle leak diagnosis or a stationary vehicle leak diagnosis is determined based on the fuel temperature in the fuel tank 10, so that a different diagnosis is carried out and therefore whether or not a leak exists can be checked by a moving vehicle leak diagnosis or a stationary vehicle leak diagnosis with regard to an area for which conventionally, a leak diagnosis could not be carried out, such as, when the gas space is large in the case of a moving vehicle leak diagnosis. Consequently, the number of executions of a leak diagnosis may be increased.

When the moving vehicle leak diagnosis is executed, the stationary vehicle leak diagnosis is invalidated, and therefore the number of executions of the stationary vehicle leak diagnosis can be limited, allowing a lightening of the battery load. The stationary leak diagnosis puts a load on the battery after the engine is stopped because it requires electric conduction in order to close the drain cut valve 8 after the engine is stopped.

The preceding description has been presented only to illustrate and describe exemplary embodiments of the methods and systems of the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A leak diagnostics apparatus for a vaporized fuel processing system that purges vaporized fuel in a fuel tank of a vehicle, comprising:

a first leak diagnostic device that carries out a first leak diagnosis of the vaporized fuel processing system while the engine is operating;

a second leak diagnostic device that carries out a second leak diagnosis of the vaporized fuel processing system after the engine has stopped;

a fuel tank condition detection device that detects fuel volume in the fuel tank; and a determining device that makes a determination as to whether the first leak diagnosis or the second leak diagnosis should be carried out based on the detected fuel volume of the fuel tank, the determining device making the determination to permit execution of the first leak diagnosis and to invalidate execution of the second leak diagnosis when the detected fuel volume is the same as or greater than a designated fuel volume.

2. A leak diagnostic apparatus for a vaporized fuel processing system that purges vaporized fuel in a fuel tank of a vehicle, comprising:

a first leak diagnostic device that carries out a first leak diagnosis of the vaporized fuel processing system while the engine is operating;

a second leak diagnostic device that carries out a second leak diagnosis of the vaporized fuel processing system after the engine has stopped;

a fuel tank condition detection device that detects conditions in the fuel tank; and a determining device that determines whether the first leak diagnosis or the second leak diagnosis should be carried out based on predetermined conditions in the fuel tank.

3. A leak diagnostic apparatus for a vaporized fuel processing system according to claim 2, wherein:

the fuel tank condition detection device detects fuel volume in the fuel tank; and the determining device makes a determination that permits execution of the first leak diagnosis when the detected fuel volume is the same as or greater than a designated fuel volume, and makes a determination that permits execution of the second leak diagnosis when the detected fuel volume is less than the designated fuel volume.

4. A leak diagnostics apparatus for a vaporized fuel processing system according to claim 2, wherein the vaporized fuel processing system further includes a valve that selectively blocks a passage in the vaporized fuel processing system, and a pressure detection device that detects pressure in the vaporized fuel processing system, the first leak diagnostic device using negative pressure in an inlet passage that is generated while the engine is in operation to reduce the pressure inside the vaporized fuel processing system, then the first leak diagnostic device closing the valve to create a closed space in the vaporized fuel processing system with a reduced pressure, and the first leak diagnosis being carried out based on a pressure value inside the vaporized fuel processing system that is detected by the pressure detection device.

5. A leak diagnostics apparatus for a vaporized fuel processing system according to claim 2, wherein:

the vaporized fuel processing system further includes a valve that selectively block a passage in the vaporized fuel processing system, and a pressure detection device that detects pressure in the vaporized fuel processing system, the second leak diagnostic device creating a closed space in the vaporized fuel processing system by closing the valve after the engine is stopped, and the second leak diagnostic device carrying out the second leak diagnosis based on a pressure value in the vaporized fuel processing system that is detected by the pressure detection device.

6. A leak diagnostics apparatus for a vaporized fuel processing system that purges vaporized fuel in a fuel tank of a vehicle, comprising:

a first leak diagnostic device that carries out a first leak diagnosis of the vaporized fuel processing system while the engine is operating;

a second leak diagnostic device that carries out a second leak diagnosis of the vaporized fuel processing system after the engine has stopped;

a fuel tank condition detection device that detects fuel temperature in the fuel tank; and a determining device that makes a determination as to whether the first leak diagnosis or the second leak diagnosis should be carried out based on the detected fuel temperature, the determining device making the determination to permit the first leak diagnosis and to invalidate the second leak diagnosis when the detected fuel temperature is less than a designated temperature.

7. A leak diagnostics apparatus for a vaporized fuel processing system that purges vaporized fuel in a fuel tank of a vehicle, comprising:

a first leak diagnostic device that carries out a first leak diagnosis of the vaporized fuel processing system while the engine is operating;

a second leak diagnostic device that carries out a second leak diagnosis of the vaporized fuel processing system after the engine has stopped;

a fuel tank condition detection device that detects fuel temperature in the fuel tank; and a determining device that makes a determination as to whether the first leak diagnosis or the second leak diagnosis should be carried out based on the detected fuel temperature, the determining device making a determination to permit execution of the first leak diagnosis when the detected fuel temperature is less than a designated temperature, and making a determination to permit execution of the second leak diagnosis when the detected fuel temperature is the same or greater than the designated temperature.

8. A leak diagnostics apparatus for a vaporized fuel processing system according to claim 7, further comprising:

an ambient temperature detection device that detects ambient temperature, and wherein if the determination is made for the second leak diagnosis to be carried out, the determining device further makes an additional determination as whether or not the second leak diagnosis should be carried out by comparing the difference between the fuel temperature and the ambient temperature.

9. A leak diagnostics apparatus for a vaporized fuel processing system according to claim 8 wherein:

the determining device makes the determination to carry out the second leak diagnosis when the difference between the fuel temperature and the ambient temperature is the same or greater than a designated temperature difference, and to invalidate the second leak diagnosis when the difference between the fuel temperature and ambient temperature is less than the designated temperature difference.

10. A leak diagnostics apparatus for a vaporized fuel processing system that purges vaporized fuel in a fuel tank of a vehicle, comprising:

a first leak diagnostic device that carries out a first leak diagnosis of the vaporized fuel processing system while the engine is operating;

a second leak diagnostic device that carries out a second leak diagnosis of the vaporized fuel processing system after the engine has stopped;

a fuel tank condition detection device that detects gas space in the fuel tank; and a determining device that determines if the first leak diagnosis or the second leak diagnosis should be carried out based on the detected gas space in the fuel tank, the determining device making a determination to permit execution of the first leak diagnosis and to invalidate execution of the second leak diagnosis when the detected gas space is less than a designated gas space.

11. A leak diagnostics apparatus for a vaporized fuel processing system that purges vaporized fuel in a fuel tank of a vehicle, comprising:

a first leak diagnostic device that carries out a first leak diagnosis of the vaporized fuel processing system while the engine is operating;

a second leak diagnostic device that carries out a second leak diagnosis of the vaporized fuel processing system after the engine has stopped;

a fuel tank condition detection device that detects gas space in the fuel tank; and a determining device that determines if the first leak diagnosis or the second leak diagnosis should be carried out based on the detected gas space in the fuel tank, the determining device making a determination to permit the first leak diagnosis when the detected gas space is less than a designated gas space, and making a determination to permit the second leak diagnosis when the detected gas space is the same or greater than the designated gas space.

* * * * *